US011027933B2

(12) United States Patent
Lupi et al.

(10) Patent No.: US 11,027,933 B2
(45) Date of Patent: Jun. 8, 2021

(54) SUCTION ROLLER STRUCTURE FOR AN INTERLEAVING MACHINE

(71) Applicant: UNITED CONVERTING S.R.L., Coreglia Antelminelli (IT)

(72) Inventors: Giuseppe Lupi, Gallicano (IT); Angelo Torri, Gallicano (IT); Gianluca Giometti, Fraz. Parezzana-Capannori (IT)

(73) Assignee: UNITED CONVERTING S.R.L., Coreglia Antelminelli (IT)

( * ) Notice: Subject to any disclaimer, the term of this patent is extended or adjusted under 35 U.S.C. 154(b) by 307 days.

(21) Appl. No.: 16/087,845

(22) PCT Filed: Mar. 28, 2017

(86) PCT No.: PCT/IB2017/000316
§ 371 (c)(1),
(2) Date: Sep. 24, 2018

(87) PCT Pub. No.: WO2017/168232
PCT Pub. Date: Oct. 5, 2017

(65) Prior Publication Data

US 2020/0299084 A1 Sep. 24, 2020

(30) Foreign Application Priority Data

Mar. 29, 2016 (IT) ..... 102016000031981

(51) Int. Cl.
*B65H 5/22* (2006.01)
*B65H 45/24* (2006.01)

(52) U.S. Cl.
CPC ..... *B65H 5/226* (2013.01); *B65H 45/24* (2013.01); *B65H 2406/33* (2013.01); *B65H 2406/332* (2013.01); *B65H 2406/3614* (2013.01)

(58) Field of Classification Search
CPC .... B65H 5/226; B65H 45/24; B65H 2406/33; B65H 2406/332; B65H 2406/3614
See application file for complete search history.

(56) References Cited

U.S. PATENT DOCUMENTS

| | | | | |
|---|---|---|---|---|
| 8,852,068 | B2 * | 10/2014 | Kauppila | B65H 27/00 493/454 |
| 2004/0159999 | A1 * | 8/2004 | Dematteis | B65H 45/28 271/264 |

FOREIGN PATENT DOCUMENTS

| | | | |
|---|---|---|---|
| DE | 40 42 168 | A1 | 7/1992 |
| EP | 1457444 | A2 | 9/2004 |
| EP | 2 955 140 | A2 | 12/2015 |
| GB | 965 217 | A | 7/1964 |
| IT | BO2008A000167 | A1 | 9/2009 |

* cited by examiner

*Primary Examiner* — Howard J Sanders
(74) *Attorney, Agent, or Firm* — McGlew and Tuttle, P.C.

(57) ABSTRACT

Suction roller structure for the pneumatic transport of sheets inside an interfolding unit, comprising a suction source, an external roller (3) rotating with respect to the cylinder (1) and provided with longitudinal rows of bores (4) angularly spaced and selectively communicating with said internal cavity (2) during the angular rotation of the roller (3), a distribution of pneumatic valves (5) that are normally closed, inserted between said internal cavity (2) and at least one bore (4), cam means (6) operatively associated with the rotation of the roller (3) and arranged to open one or more of said valves (5) at one or more angular positions taken by the roller (3).

11 Claims, 9 Drawing Sheets

SECTION F-F

SECTION A-A

DET.G

SUCTION ROLLER STRUCTURE FOR AN INTERLEAVING MACHINE

TECHNICAL FIELD OF THE INVENTION

The invention relates to a suction roller to pneumatically transport sheets of paper, especially the type of suction roller used in operating units intended for cutting and/or folding interfolded sheets of paper, i.e. stacked folded sheets, in such a way as to obtain a partial overlapping of the adjacent edges of the sheets. This kind of arrangement is used, for example, to manufacture packs of stacked napkins in such a way that upon extracting the napkin in the extraction position, one edge of the underlying napkin is automatically lifted, in such a way as to ease the extraction of the following napkin.

This type of arrangement may be used for toilet paper, face tissues and more.

STATE OF THE ART

It is known that interfolders are equipped with a couple of juxtaposed and counter-rotating rollers, through which the sheets of paper to be folded/cut are fed.

Depending on the task that must be performed, cutting blades or projections may be present on the surfaces of one of the rollers and, on the opposite roller, there are corresponding slots which rotate in line with the blades/projections so as to have the processed sheet of paper cut or folded.

Once folding is performed, the sheets of paper are moved to an underlying device, which is known as a "stacker", which forms numerical stacks of sheets and works in line with the rotation of rollers.

During the operations, rollers must also perform the task of keeping the sheets adhering to the external surface.

To this end, the rollers of the interfolding units are equipped with bores connected to a suction system, which can be laterally or centrally mounted with respect to the roller.

A central suction system is known from EP1457444, which envisages a central vacuum source, comprising a fixed hollow cylinder, which through partial suction chambers is transferred to bores on the external surface of the rotating suction roller, so as to selectively activate the communication of the external bores distributed on the section of the cylinder that corresponds to the partial suction chamber, with the machine's suction system during the relative rotation of the two bodies.

The solution known from EP1457444 has some drawbacks though, since the communication selection between the internal cylinder and the external bores is ensured by sliding seals that are in contact with the internal surface of the suction roller, and are thus worn out and drawn, and subjected to high friction since the seals are subject to high wear (and thus to regular maintenance), which is also due to the relatively high vacuum that must be created in order achieve the desired suction effect on the surface.

Moreover, this system, when applied to the folding rollers of interfolders, needs them to be fed by also using a side suction system, or else it is not possible to switch between the suction phase and the release phase of the sheets of paper in the operation area of the rollers, according to the angular position of the folding rollers. Moreover, the system disclosed by EP1457444 is relatively rigid if the format of the transported sheets of paper must be changed, and thus the angular distance between the suction bores that are activated one after the other must be adjusted. The need is thus felt for a suction roller, especially for interfolding units for sheets of paper, based on a reliable and efficient structure, and characterized by a suction system able to flexibly adjust to any possible change to the format of the sheets of paper.

OBJECT OF THE INVENTION

The present invention is intended to provide a suction roller to be used with interfolding units, which allows to overcome the drawbacks of the already known solutions.

According to the invention, the object is achieved by using a suction roller for interfolding units according to the main claim.

Further technical objects and advantages are achieved by units according to the dependent claims.

SUMMARY OF THE INVENTION

A first advantage is that the suction roller of the invention allows the operator to select the arrangement and succession of the external suction bores in a simple and reliable way.

A second advantage is that the suction system can be adapted if the format of the processed sheets of paper is changed.

LIST OF THE DRAWINGS

These and other advantages will be better understood by anyone skilled in the art thanks to the following specification and the accompanying drawings, given as a non-limiting example, wherein:

FIG. 1 schematically shows an axonometric view of a suction roller for an interfolding unit according to the invention;

Figure 1:
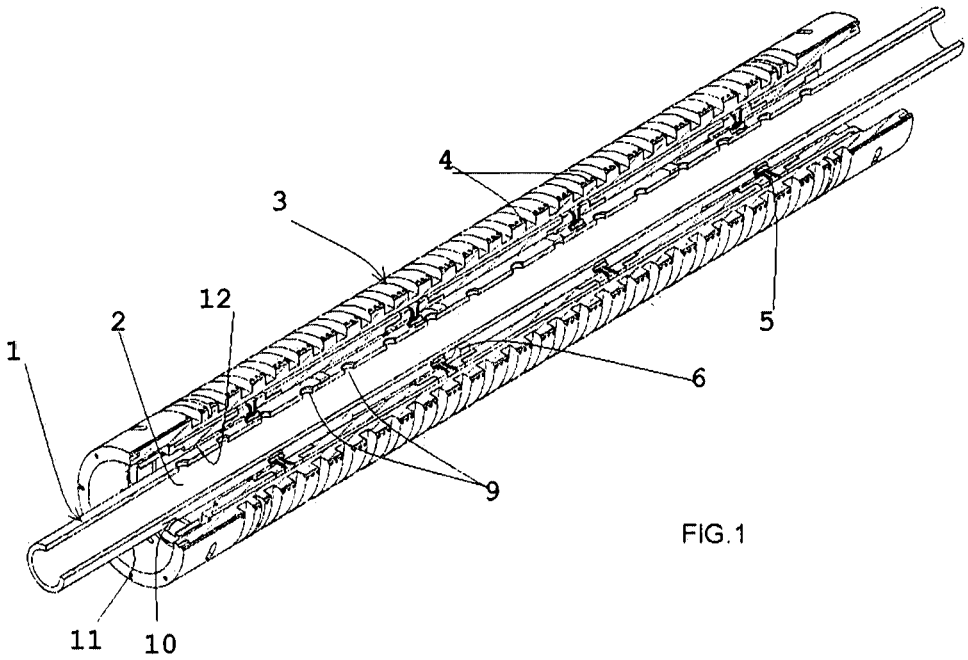
Figure 18:
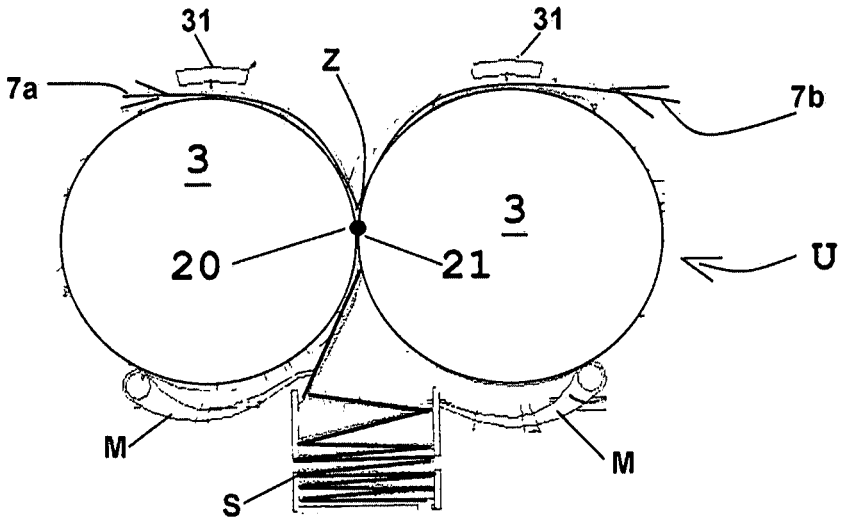
Figure 19:
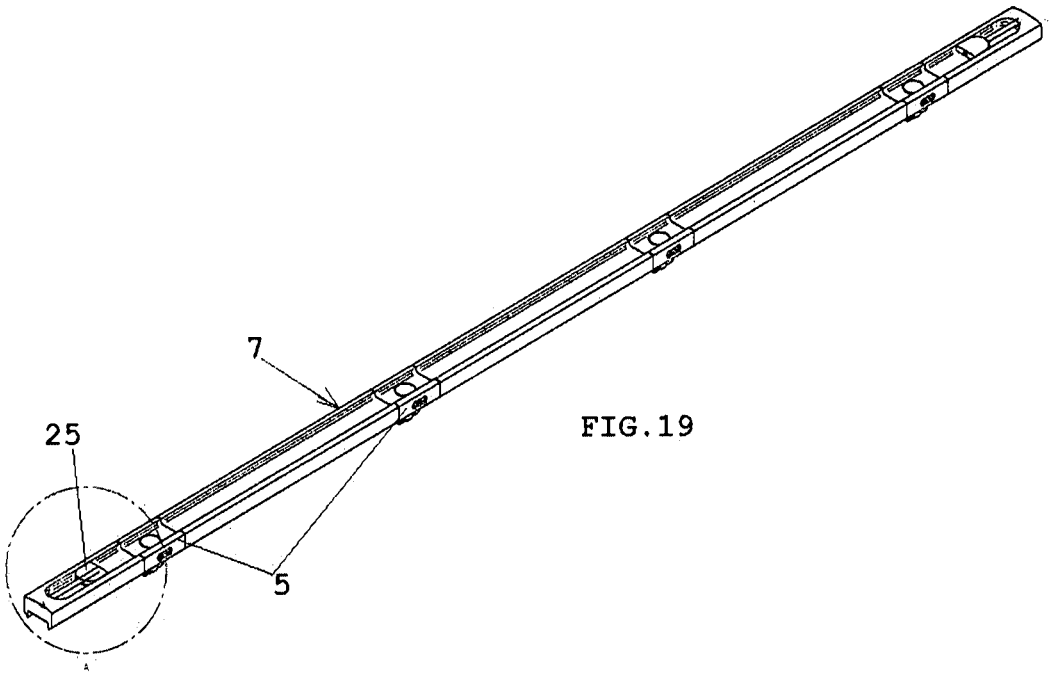
Figure 20:
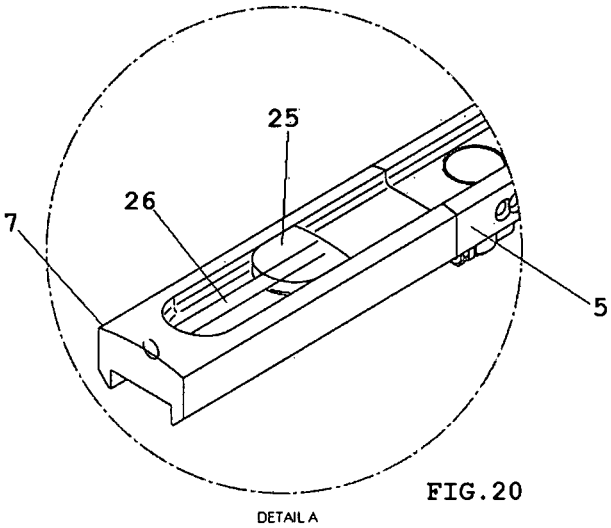
Figure 21:
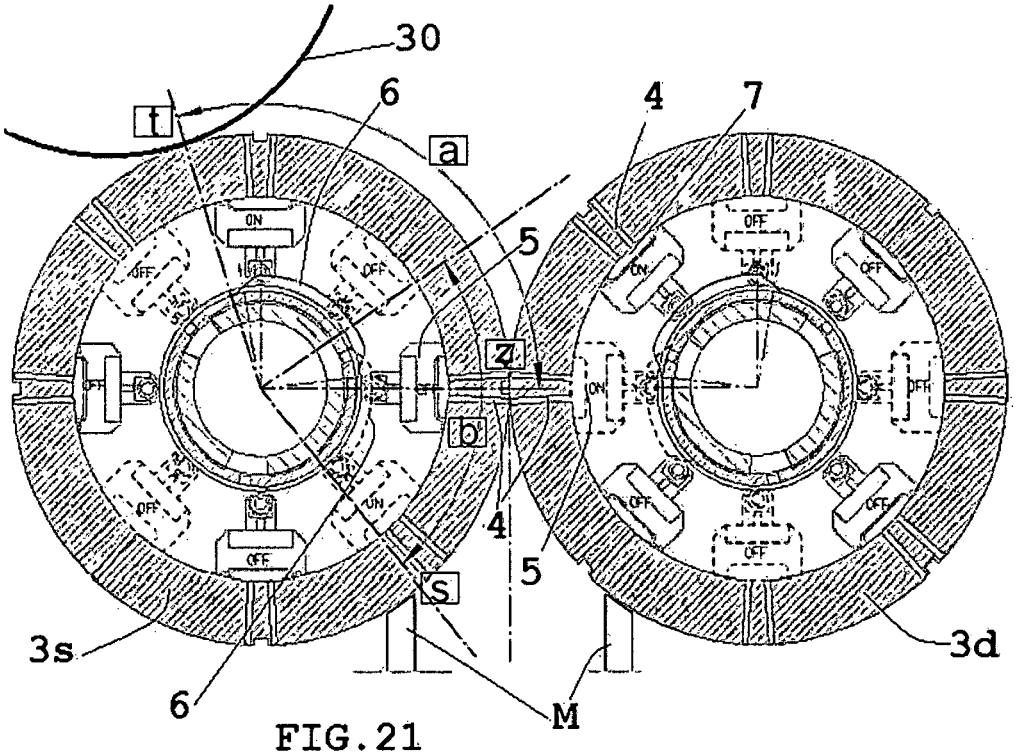
Figure 22:
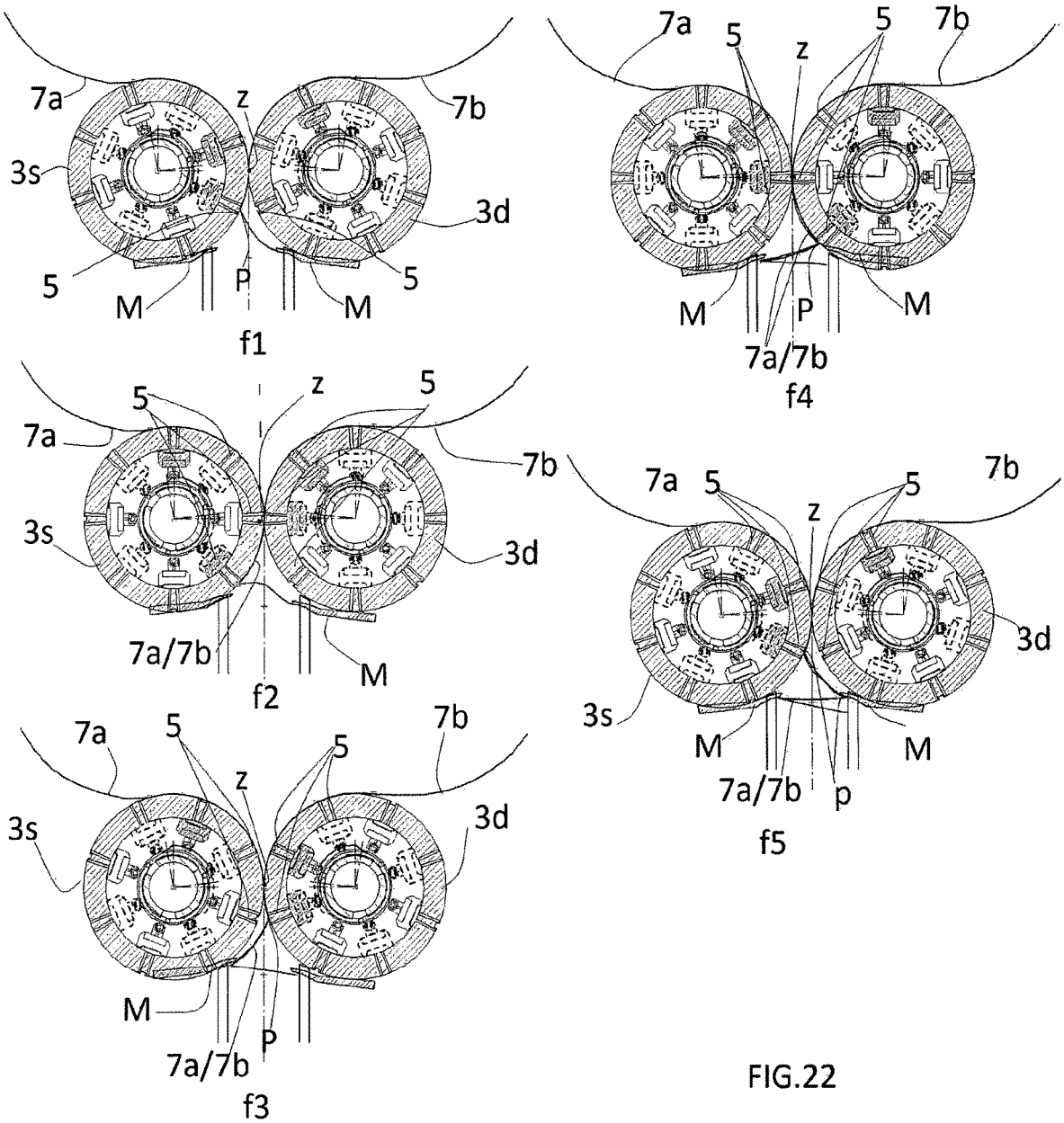

FIG. 18 schematically shows an interfolder equipped with suction rollers according to the invention;

FIG. 19 shows a preferred embodiment of the longitudinal suction chamber of the roller of FIG. 1 in an isometric view;

FIG. 20 shows the detail A of FIG. 19;

FIG. 21 schematically shows two suction rollers while the interfolding unit is running;

FIG. 22 schematically shows the functioning of the machine in FIG. 21.

DETAILED DESCRIPTION

With reference to the attached drawings, described herein is a preferred embodiment of a structure, according to the invention, of a suction roller for pneumatically transporting sheets, which is especially used in a U-shaped interfolding unit.

Figure 2:
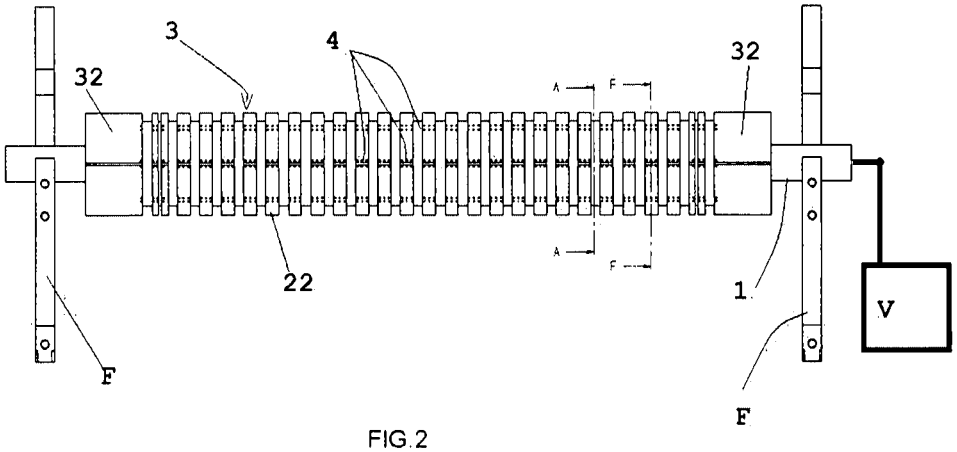
FIG. 2 shows the roller of FIG. 1 in a longitudinal front view.
Figure 3:
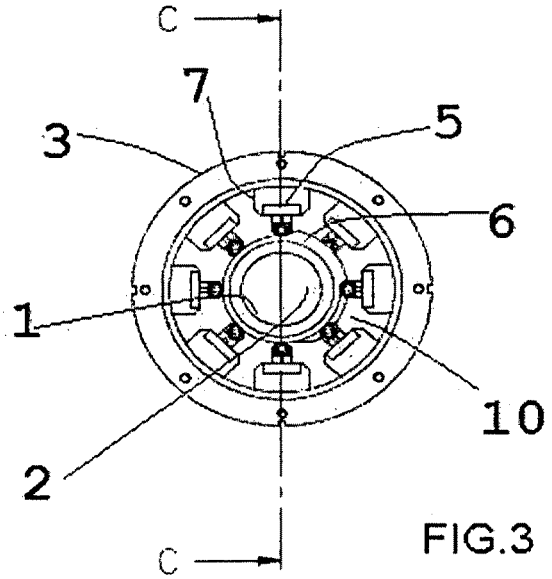
FIG. 3 shows the roller of FIG. 1 in a side view.
Figure 4:
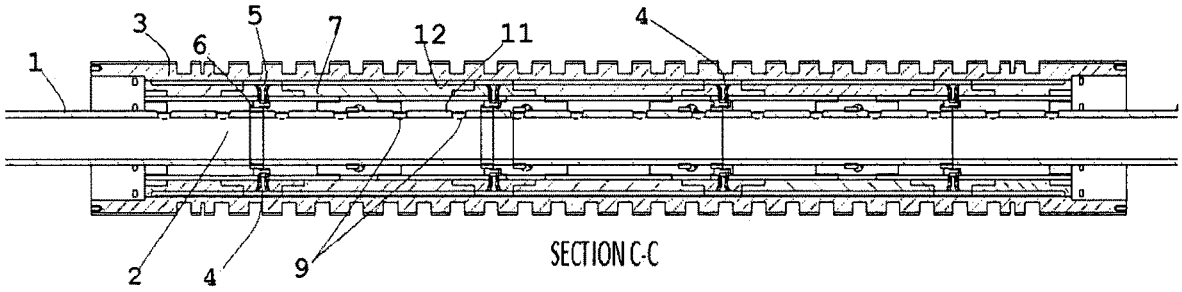
FIG. 4 shows the roller of FIG. 3 in a longitudinal C-C section.
Figure 5:
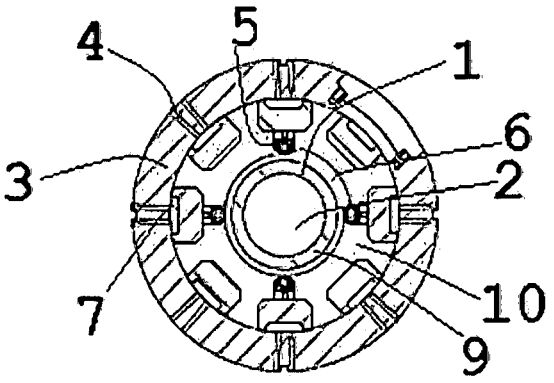
FIG. 5 shows the roller of FIG. 2 in a diagonal F-F section.
Figure 6:
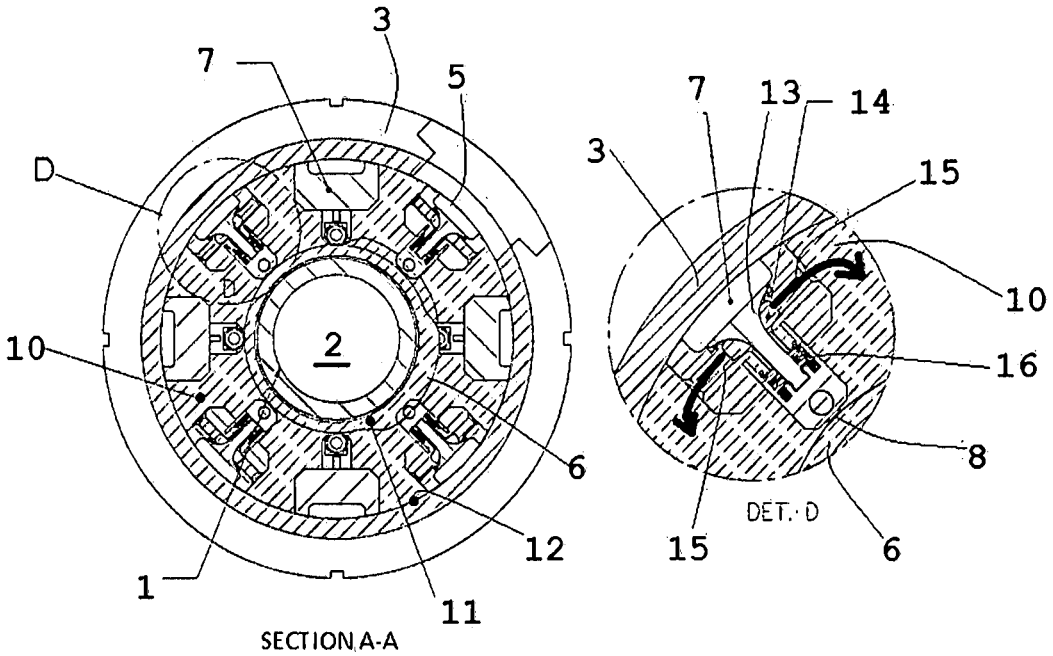
FIG. 6 shows the roller of FIG. 2 in a diagonal A-A section and a detail D.
Figure 8:
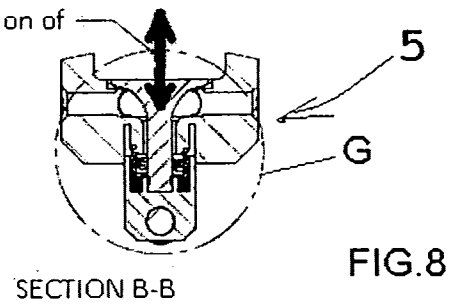
FIG. 8 shows the valve of FIG. 7 in a B-B section.
Figure 7:
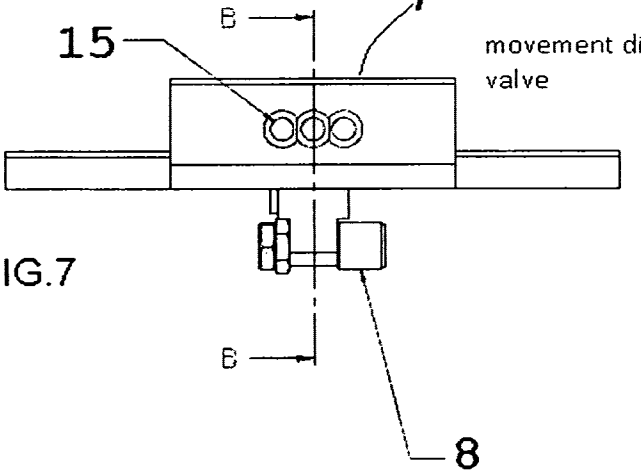
FIG. 7 shows the detail pertaining to a valve used in the roller of the invention.
Figure 10:
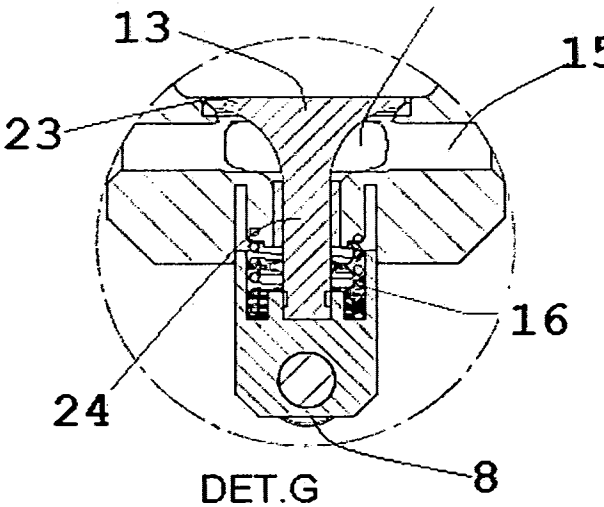
FIG. 10 shows a detail G of FIG. 8.
Figure 9:
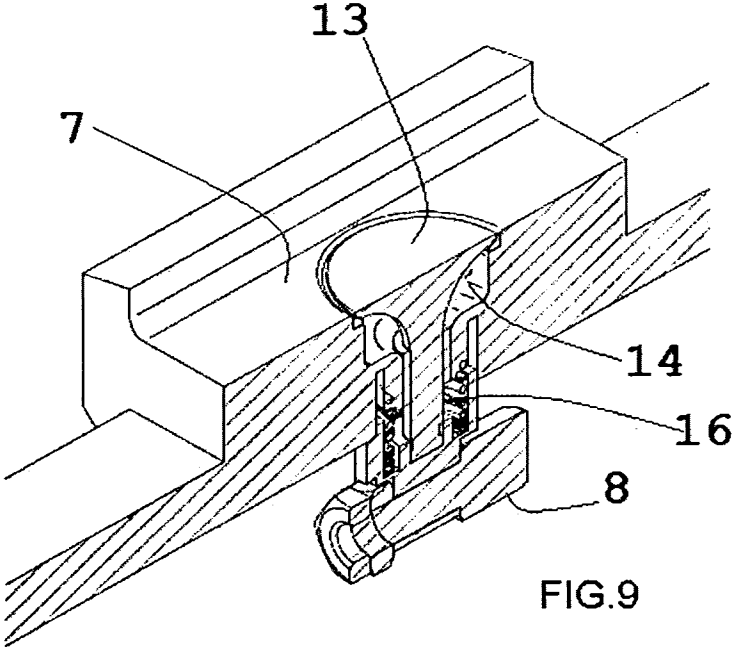
FIG. 9 shows an isometric view of a valve used in the roller of the invention, a few pieces of which have been removed for a better understanding.
Figure 12:
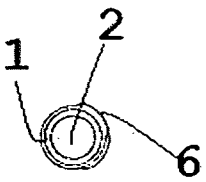
FIG. 12 shows the cylinder of FIG. 11 in a side view.
Figure 11:
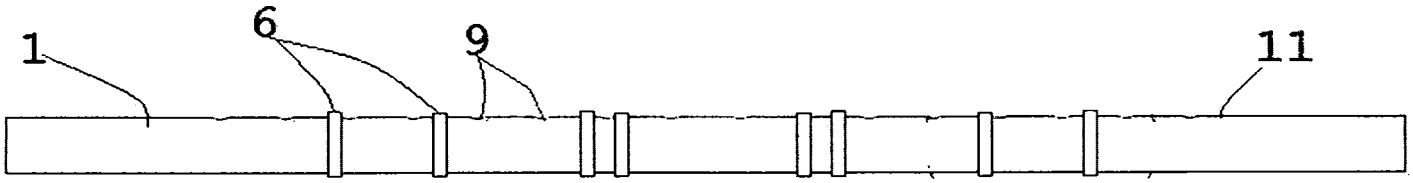
FIG. 11 shows the internal hollow cylinder of the roller of FIG. 1 in a longitudinal front view.
Figure 13:
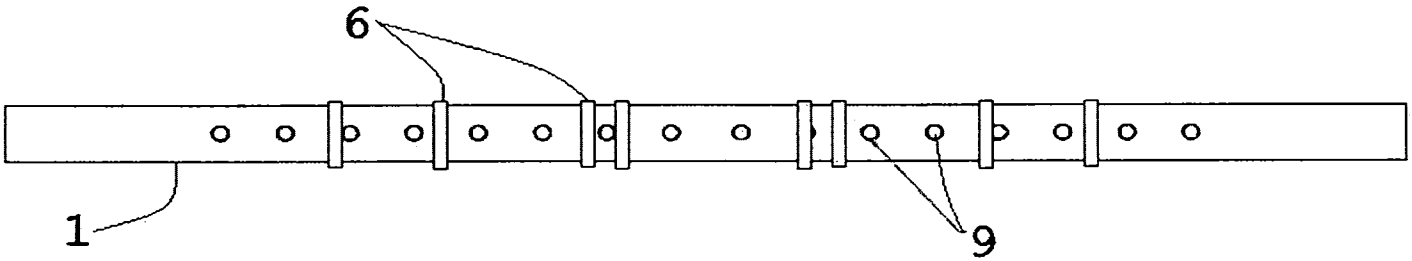
FIG. 13 shows the cylinder of FIG. 11 in a top view.
Figure 14:
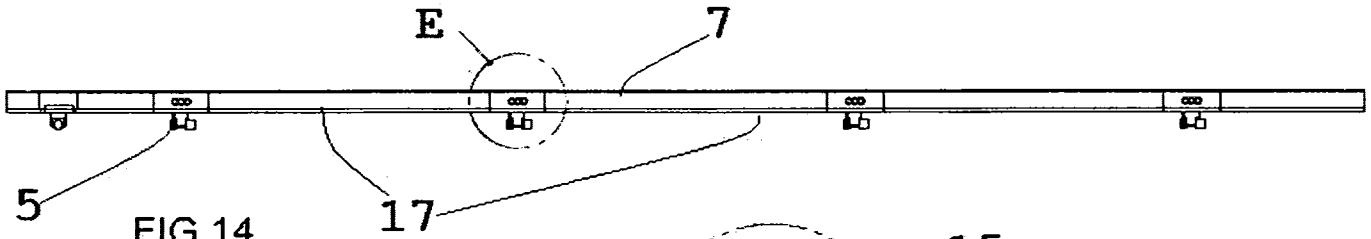
FIG. 14 shows a longitudinal suction chamber of the roller of FIG. 1 in a longitudinal front view.
Figure 15:
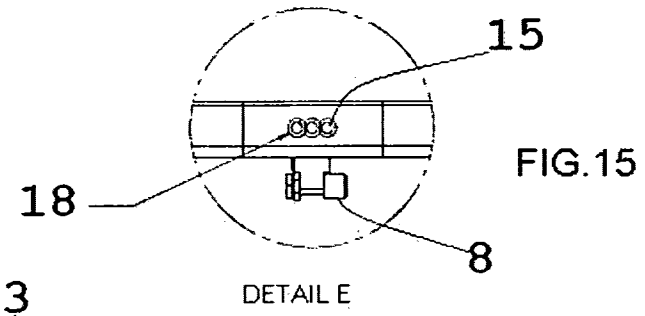
FIG. 15 shows the detail G of FIG. 14.
Figure 16:
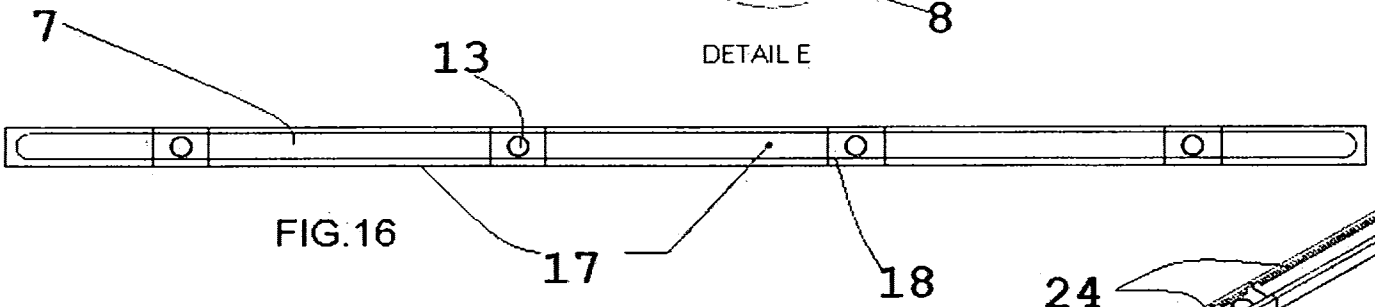
FIG. 16 shows the top view of the chamber of FIG. 14.
Figure 17:
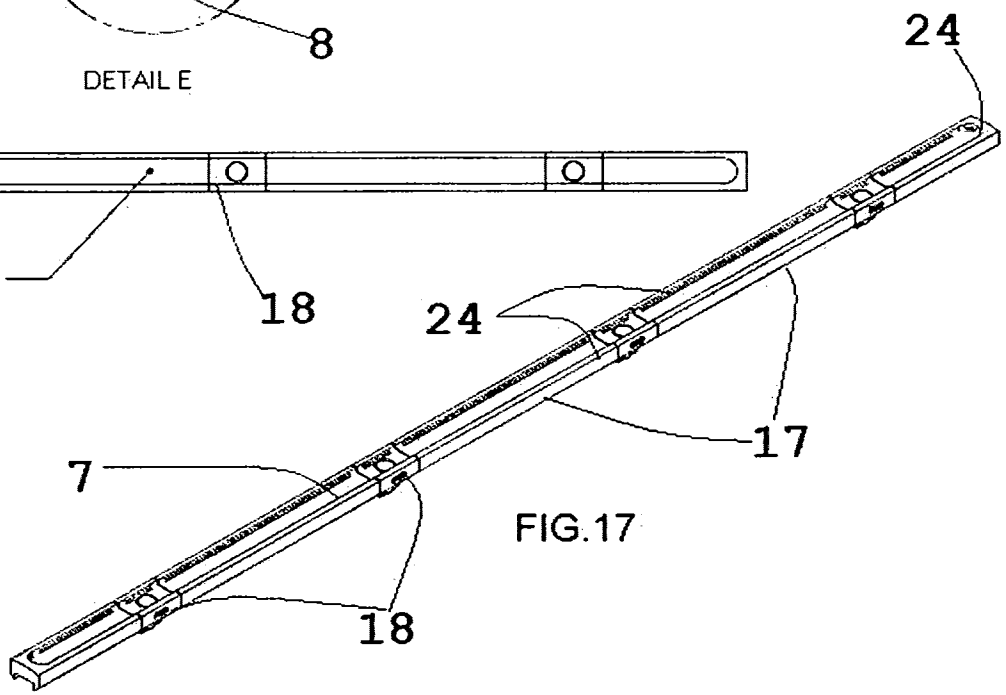
FIG. 17 shows an isometric view of the chamber of FIG. 14.

The structure comprises a hollow cylinder 1 equipped with an internal cavity 2, which is preferably fixedly mounted onto a pair of sides F so that the cavity 2 is constantly connected to a suction source V (FIG. 2).

Moreover, an external roller 3 is mounted onto cylinder 1, rotatable with respect to cylinder 1, for instance on side bearings 32, and is provided with longitudinal rows of bores 4 angularly spaced (for example eight equally spaced rows) and selectively communicating with said internal cavity 2 during the angular rotation of the roller 3. Preferably, the roller 3 is a folding roller of the type used in pairs in interfolders to fold successions of sheets 7*a*, 7*b* at a common tangency point Z, in order to create stacks of interfolded sheets S (FIG. 18) in combination with detachment elements M that detach the sheet from the rollers.

To this end, the roller 3 may be equipped with an external grooved surface 22 that transports the sheets and towards which the bores 4 are faced.

The functioning of an interfolder is generally known, for example from the Italian patent application BO2008A000167 in the name of the same inventors and is thus not described in further detail.

According to the invention, the structure of the roller comprises an arrangement of pneumatic valves 5 that are normally closed and inserted between the internal cavity 2 of the hollow cylinder 1 and at least one bore 4 of the roller 3, preferably a longitudinal row of bores 4.

In order to achieve the selective communication of bores 4 with the vacuum cavity 2, cam means 6 are envisaged and operatively associated to rotation of the roller 3 and arranged to be able to open one or more of said valves 5 at one or more angular positions taken by the roller 3.

In the described embodiment, the hollow cylinder 1 comprises an arrangement of bores 9 to establish a pneumatic communication between the internal cavity 2 and a ring gap 10 that is generally defined by the external surface 11 of the internal cylinder 1 and the internal surface 12 of the roller 3 and towards which valves 5 are faced, normally closed.

Preferably, valves 5 comprise a shutter 13 that is normally closed, equipped with a sealing head 23 and a stem 24, interposed between a vacuum volume 14 communicating with the gap 10 and the bores 4 of the roller 3. Valves 5 are also equipped with an actuation element 8, for instance a small wheel connected to the stem 24, that can be activated by the cam means 6 against the thrust of an elastic return element 16 as a reaction to the rotation of the roller 3.

In the described example, cam means 6 comprise at least an external ring profile of the hollow cylinder 1 arranged in correspondence to at least one actuation element 8 of at least one valve 5.

What is understood, however, is that various embodiments of the cam means will be possible, as well as various technical solutions for actuating the valves 5.

In particular, cam means 6 may be fixed or adjustable (for example, by providing cam profiles that can be replaced or adjusted in an angular position with respect to cylinder 1) in order to be able to change the angular phase of the opening/closing of the valves 5.

With particular reference to FIGS. 14 to 20, the valves 5 are mounted along at least one longitudinal chamber 7 placed in the space of the gap 10 and secured by means of a pneumatic seal with respect to the internal surface of the roller 3 by at least one longitudinal row of bores 4.

Thanks to this solution, the chamber 7 is pneumatically isolated with respect to the gap 10 and the vacuum volume 14 constantly communicates with the gap 10 by means of transverse bores 15 of the longitudinal chamber 7.

Particularly, the pneumatic seal of chamber 7 is obtained by seal-applying the peripheral edges 24 of the chamber 7 to the internal surface 12 of the roller and by fixing the chamber 7 to the roller, for example by means of screws.

Preferably, moreover, the longitudinal chamber 7 is in the shape of a longitudinal profile made of linear modules or segments 17, alternating with valve-holding blocks 18.

In this way, it is possible to compose chambers 7 of the correct length for the roller 3, to be put in suction, and to place the valves in the desired position.

FIGS. 19, 20 show a preferred embodiment of the chamber 7.

In this embodiment, the chamber 7 comprises one or more sealing buffers 25 that can be placed at predetermined positions along the chamber 7 at the sides of the valves 5. In different embodiments, the buffers 25 may be securely positioned by means of screws or by means of adjusting means, such as a threaded rod 26 that is accessible and operable from the outside, at the ends of the chamber 7. Advantageously, this solution allows to adjust, and possibly section into several sectors, the transverse width of the volume of the chamber that is subject to the suction phase, thus increasing the flexibility of the system for the transport of sheets of different transverse format, without having to plug the bores 4 and without reducing the efficiency and speed of the suction and release phases.

What is specified is that in a different embodiment, the chamber 7 can be obtained directly in the thickness of the roller 3 itself instead of being taken back.

With particular reference to FIG. 21, the functioning of two folding rollers according to the invention is shown, upon the exchange of the sheet from a roller 3*s* (shown on the left in the representation) to the other roller 3*d*.

In order to achieve the exchange, the valves 5 of the roller 3*s* are closed and do not create vacuum in the bores 4, while the valves 5 of the roller 3*d* enters the vacuum state and hold the sheet.

In the figure, "a" indicates the angular position of the cams 6 of the roller that hold the valves 5 open, and thus in the vacuum state, such valves holding the head and tail edges of the sheets to be folded, and "b" indicates the angular position of the cams 6 of the roller (indicated by a dotted line) that hold the valves open, such valves holding the central portion of the same sheets.

During the rotation of the suction rollers 3*s*, 3*d*, cams 6 in the "a" position cause the valves 5 to open at the point "t" of the exchange of the sheet between the cutting roller 31—placed above (and only schematically shown in the figure)—and the folding roller 3*s* and let the valves close at the tangency point "z" between the left and right folding rollers 3*s*, 3*d*.

Cams corresponding to the angle "b" cause instead the valves to open at the tangency point z and close them at the point S, where the sheet must be detached from the underlying detachment elements M.

As a result of the succession of the hold and release phases of the sheet and of the rotation of the folding roller, the cut sheet is then transported, folded by the two rollers at the tangency point "z" and then released at the bottom.

As it is known in the sector, in order to obtain interfolding, the succession of the suction and release states as described above keeps going in an alternate way in the two rollers 3*s*, 3*d* in order to transport, fold and release the two successions of sheets fed to the two left and right rollers and staggered in the longitudinal direction. FIG. 22 schematically shows phases f1-f5 of interfolding of two successions of sheets 7*a*, 7*b*, performed with a pair of folding rollers 3*s*, 3*d* according to the present invention.

Phase f1

During this phase, a first fold P between the first and the second face of a sheet 7*a* wrapped on the first roller 3*s* is created, the sheets 7*a* and 7*b* are coupled starting from the tangency point Z;

the valves 5 of the first roller 3*s* immediately upstream and downstream of the tangency point z are in suction and rotatively drag the tail edge of the first face and the second face of the sheet 7*a,* the valves 5 of the second roller 3*d*, immediately downstream of the tangency point, are closed, the element M of the second roller 3*d* has started the detachment of the head edge of the first face of sheet 7*a,*

Phase f2 the valves 5 of the first roller 3*s*, immediately downstream of the tangency point z, are still in suction mode and rotatively drag the second face of the sheet 7*a* and the first face, coupled to it, of the second sheet 7*b;* the valves 5 of the second roller 3*d*, upstream of the tangency point, are open and drag the second sheet 7*b;* the element M of the second roller 3*d* has performed the detachment of the head edge of the first face of sheet 7*a;*

Phase f3 during this phase, the succession of foldings of the interfolded (that is partially overlapped) sheets 7*a*, 7*b* begins, the valves 5 of the first roller 3*s*, immediately upstream of the tangency point z, are open and feed a sheet 7*a* towards the tangency point Z, the valves 5 of the first roller 3*s*, immediately downstream of the tangency point z, are closed, and they do not hold the coupled sheets 7*a*/7*b;* the valves 5 of the second roller 3*d*, upstream of the tangency point, are open and drag the second sheet 7*b;* the valves 5 of the second roller 3*d*, downstream of the tangency point, are open and drag the coupled sheets 7*a*/7*b*, thus forming a further fold P, the element M of the first roller 3*s* has started the detachment of the coupled sheets 7*a*/7*b*.

Phase f4 at this phase, the first interfolding of two staggered sheets 7*a*, 7*b* has been already obtained, the valves 5 of the first roller 3*s* immediately upstream of the tangency point z are open and drag a sheet 7*a* to the tangency point Z, the valves 5 of the first roller 3*s*, immediately downstream of the tangency point z, are closed, and they do not hold the coupled sheets 7*a*/7*b;* the valves 5 of the second roller 3*d*, upstream of the tangency point, are open and drag the second sheet 7*b;* the valves 5 of the second roller 3*d*, downstream of the tangency point, are open and drag the coupled sheets 7*a*/7*b*, thus completing the further fold P, the element M of the first roller 3*s* has completed the detachment of the coupled sheets 7*a*/7*b;* the element M of the second roller 3*d* is about to start the detachment of the coupled sheets 7*a*/7*b* upstream of the further fold p;

Phase f5 in this phase, the second interfolding of two staggered sheets 7*a*, 7*b* has been obtained, the valves 5 of the first roller 3*s* immediately upstream of the tangency point z are open and drag a sheet 7*a* to the tangency point Z, the valves 5 of the first roller 3*s*, immediately downstream of the tangency point z, are open and drag the coupled sheets 7*a*/7*b*, starting to form another further fold P;

the valves 5 of the second roller 3*d* upstream of the tangency point are open and drag the second sheet 7*b* towards the tangency point;

the valves 5 of the second roller 3*d*, downstream of the tangency point, are closed, and do not hold the coupled sheets 7*a*/7*b,* the element M of the second roller 3*d* has started the detachment of the coupled sheets 7*a*/7*b* upstream of the fold P that had been previously created.

The described phases are repeated in succession and the interfolded sheets 7*a*/7*b* are stacked at the bottom, forming a stack of interfolded sheets.

The invention presents important advantages in that the provided seals are tight, there is no drawing or dragging, friction is low and allows energy saving and reduced pollution, and furthermore, they can independently enter the suction mode and, when valves are activated, the vacuum does not affect the friction inside the roller.

A further advantageous aspect is that a single suction system feeds all the rollers of the interfolder.

A further advantageous aspect is that the valves may change in number, but they are all the same regardless of the number of sheets to be processed.

A further advantageous aspect is that the roller can be equipped with different sectors, and each sector can be provided with an internal buffer, which may have different positions with respect to the valves and can thus close selected bores by reducing the suction chamber.

A further advantageous aspect is that the shutter valves are long-lived over the years and they can be changed without disassembling the roller.

A further advantageous aspect is that the adjustment of the transport and transfer suction of sheets is made easier, with the possibility of installing an automatic suction variation system, that might be advanced or delayed.

The present invention has been described according to preferred embodiments, but equivalent variants can be designed without departing from the agreed scope of protection.

The invention claimed is:

1. A suction roller structure to pneumatically transport sheets, the suction roller structure comprising:

a suction source;

a rotating external roller comprising longitudinal rows of bores angularly spaced and said longitudinal rows of bores selectively communicating with said suction source during angular rotation of said rotating external roller, said suction source comprising an internal cavity of an inner hollow cylinder and said rotating external roller being rotatable with respect to said inner hollow cylinder, said inner hollow cylinder comprising an arrangement of bores to establish a pneumatic communication between said internal cavity and a ring gap defined by an external surface of said inner hollow cylinder and an internal surface of said rotating external roller;

a distribution of intermediate suction chambers communicating and associated with corresponding longitudinal rows of bores;

a distribution of pneumatic valves, each of said pneumatic valves being interposed between said suction source and one of said intermediate suction chambers; and an actuation means operatively associated with said rotation of said rotating external roller and arranged for opening one or more of said pneumatic valves at one or more angular positions taken by said rotating external roller.

2. A structure according to claim 1, wherein said pneumatic valves comprise a shutter and an actuation element, said shutter being closed, interposed between a vacuum volume communicating with said ring gap and said bores of said rotating external roller, said actuation element being actuated by said actuation means against a thrust of an elastic return element as a reaction to the rotation of said rotating external roller.

3. A structure according to claim 2, wherein said pneumatic valves are mounted along at least one longitudinal chamber, arranged in said ring gap and seal-secured with respect to an inner surface of said rotating external roller, in correspondence to at least one row of longitudinal bores, and said vacuum volume comprises a volume communicating with said ring gap by transverse bores of said at least one longitudinal chamber.

4. A structure according to claim 3, wherein said at least one longitudinal chamber is formed by a modular composition of linear segments and valve-holding blocks.

5. A structure according to claim 3, wherein said at least one longitudinal chamber is integrally made with said rotating external roller.

6. A structure according to claim 3, wherein said at least one longitudinal chamber comprises one or more pneumatically sealing sectioning buffers placed at predetermined positions along said at least one longitudinal chamber.

7. A structure according to claim 6, further comprising a means for adjusting at least one of said predetermined positions of said one or more pneumatically sealing sectioning buffers.

8. A structure according to claim 1, wherein said actuation means comprises a cam means.

9. A structure according to claim 8, wherein said cam means comprises at least an outer ring profile arranged in correspondence to at least one actuation element of at least one of said pneumatic valves.

10. A structure according to claim 8, further comprising a means for adjusting or replacing said cam means.

11. An interfolding unit comprising:

a pair of folding rollers arranged side by side and counter-rotating to operate at a common tangency point on successions of sheets fed according to a staggered position between said pair of folding rollers, at least one of said folding rollers comprising a suction roller structure, said suction roller structure comprising a suction source, a rotating external roller, a distribution of intermediate suction chambers, a distribution of pneumatic valves and an actuation means, said rotating external roller comprising longitudinal rows of bores angularly spaced and said longitudinal rows of bores selectively communicating with said suction source during angular rotation of said rotating external roller, said distribution of intermediate suction chambers communicating and being associated with corresponding longitudinal rows of bores, each of said pneumatic valves being interposed between said suction source and one of said intermediate suction chambers, said actuation means being operatively associated with said rotation of said rotating external roller and arranged for opening one or more of said pneumatic valves at one or more angular positions taken by said rotating external roller, said suction source comprising an internal cavity of an inner hollow cylinder and said rotating external roller being rotatable with respect to said inner hollow cylinder, said inner hollow cylinder comprising an arrangement of bores to establish a pneumatic communication between said internal cavity and a ring gap defined by an external surface of said inner hollow cylinder and an internal surface of said rotating external roller.

* * * * *